US010125613B2

(12) United States Patent
Savage et al.

(10) Patent No.: US 10,125,613 B2
(45) Date of Patent: Nov. 13, 2018

(54) SHROUDED TURBINE BLADE WITH CUT CORNER

(71) Applicant: United Technologies Corporation, Hartford, CT (US)

(72) Inventors: Eric S. Savage, Vernon, CT (US); Christopher Corcoran, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 616 days.

(21) Appl. No.: 14/650,090

(22) PCT Filed: Dec. 17, 2013

(86) PCT No.: PCT/US2013/075817
§ 371 (c)(1),
(2) Date: Jun. 5, 2015

(87) PCT Pub. No.: WO2014/105533
PCT Pub. Date: Jul. 3, 2014

(65) Prior Publication Data

US 2015/0315918 A1 Nov. 5, 2015

Related U.S. Application Data

(60) Provisional application No. 61/746,766, filed on Dec. 28, 2012.

(51) Int. Cl.

| | |
|---|---|
| ***F01D 5/16*** | (2006.01) |
| ***F01D 5/14*** | (2006.01) |
| ***F01D 5/22*** | (2006.01) |
| ***F01D 25/06*** | (2006.01) |
| ***F01D 5/26*** | (2006.01) |

(52) U.S. Cl.
CPC ..... *F01D 5/16* (2013.01); *F01D 5/147* (2013.01); *F01D 5/225* (2013.01); *F01D 5/26* (2013.01); *F01D 25/06* (2013.01); *F05D 2220/32* (2013.01); *F05D 2230/10* (2013.01);
(Continued)

(58) Field of Classification Search
CPC . F01D 5/147; F01D 5/16; F01D 5/225; F01D 5/26
See application file for complete search history.

(56) References Cited

U.S. PATENT DOCUMENTS 5,097,711 A 3/1992 Rozelle et al.
5,156,529 A 10/1992 Ferleger et al.
(Continued)

FOREIGN PATENT DOCUMENTS

EP 2500524 A1 9/2012
JP 8303204 A 11/1996
JP 2004285931 A 10/2004

OTHER PUBLICATIONS

Extended European Search Report for EP Application No. 13867362.9, dated Jul. 8, 2016, 7 pages.
(Continued)

*Primary Examiner* — Woody Lee, Jr.
(74) *Attorney, Agent, or Firm* — Kinney & Lange, P.A.

(57) ABSTRACT

A method includes determining a vibration characteristic of a shrouded turbine blade, which includes an airfoil attached to a shroud. A corner of the shrouded turbine blade can be removed after determining the vibration characteristic.

15 Claims, 4 Drawing Sheets

(52) U.S. Cl.
CPC .... *F05D 2260/96* (2013.01); *F05D 2260/961* (2013.01); *Y10T 29/49337* (2015.01)

(56) References Cited

U.S. PATENT DOCUMENTS

| | | | | |
|---|---|---|---|---|
| 5,498,136 | A | 3/1996 | Namura et al. | |
| 5,599,165 | A | 2/1997 | Elaini et al. | |
| 6,164,916 | A * | 12/2000 | Frost | B23K 35/3046 148/528 |
| 6,471,482 | B2 | 10/2002 | Montgomery et al. | |
| 7,887,295 | B2 | 2/2011 | Brittingham et al. | |
| 7,975,354 | B2 | 7/2011 | Greenberg et al. | |
| 7,976,280 | B2 * | 7/2011 | Brittingham | F01D 5/147 416/189 |
| 8,172,511 | B2 | 5/2012 | Duong et al. | |
| 2008/0134504 | A1 | 6/2008 | Schoenenborn | |
| 2008/0145228 | A1 | 6/2008 | Truckenmueller et al. | |
| 2008/0206057 | A1 * | 8/2008 | Twerdochlib | F01D 5/225 416/190 |
| 2010/0068034 | A1 | 3/2010 | Schiavo et al. | |
| 2010/0196160 | A1 | 8/2010 | Hudson | |
| 2012/0237348 | A1 | 9/2012 | Thomen et al. | |
| 2012/0237350 | A1 * | 9/2012 | Corcoran | F01D 5/22 416/220 R |

OTHER PUBLICATIONS

International Searching Authority, PCT Notification of Transmittal of the International Search Report and the Written Opinion, dated Apr. 7, 2014, 12 pages.

* cited by examiner

SHROUDED TURBINE BLADE WITH CUT CORNER

BACKGROUND

The present invention relates to gas turbine engines, and in particular, to turbine blades used in gas turbine engines.

Gas turbine engines typically include one or more compressor sections and turbine sections. The compressor and turbine sections can include a number of airfoils, including rotating blades and stationary vanes. Various components in gas turbine engines can experience vibration conditions during operation of the gas turbine engines. Certain vibration characteristics can be damaging to engine components. For example, in some gas turbine engines, turbine blades can be damaged by certain vibration characteristics. Such damage can shorten the useful life of turbine blades and possibly cause failure of the gas turbine engine.

SUMMARY

According to the present invention, a method includes determining a vibration characteristic of a shrouded turbine blade, which includes an airfoil attached to a shroud. A corner of the shrouded turbine blade can be removed after determining the vibration characteristic.

Another embodiment is a shrouded turbine blade that includes a airfoil having an outer end and an outer shroud attached to the outer end. The outer shroud includes a first mate face having a first z-lock shape and a second mate face opposite the first mate face and having a second z-lock shape that is complementary to the first z-lock shape. There is a machined cut on a corner of the outer shroud extending from a leading edge of the outer shroud to the second mate face.

Another embodiment is a shrouded turbine blade including a airfoil having an airfoil leading edge and an outer shroud attached to an outer end of the airfoil. The outer shroud includes a first mate face, a second mate face opposite the first mate face, an outer shroud leading edge positioned axially forward of the airfoil leading edge, and a diagonal edge of the outer shroud extending from the outer shroud leading edge to the second mate face. The diagonal edge connects to the second mate face axially aft of the airfoil leading edge.

DETAILED DESCRIPTION

Figure 1:
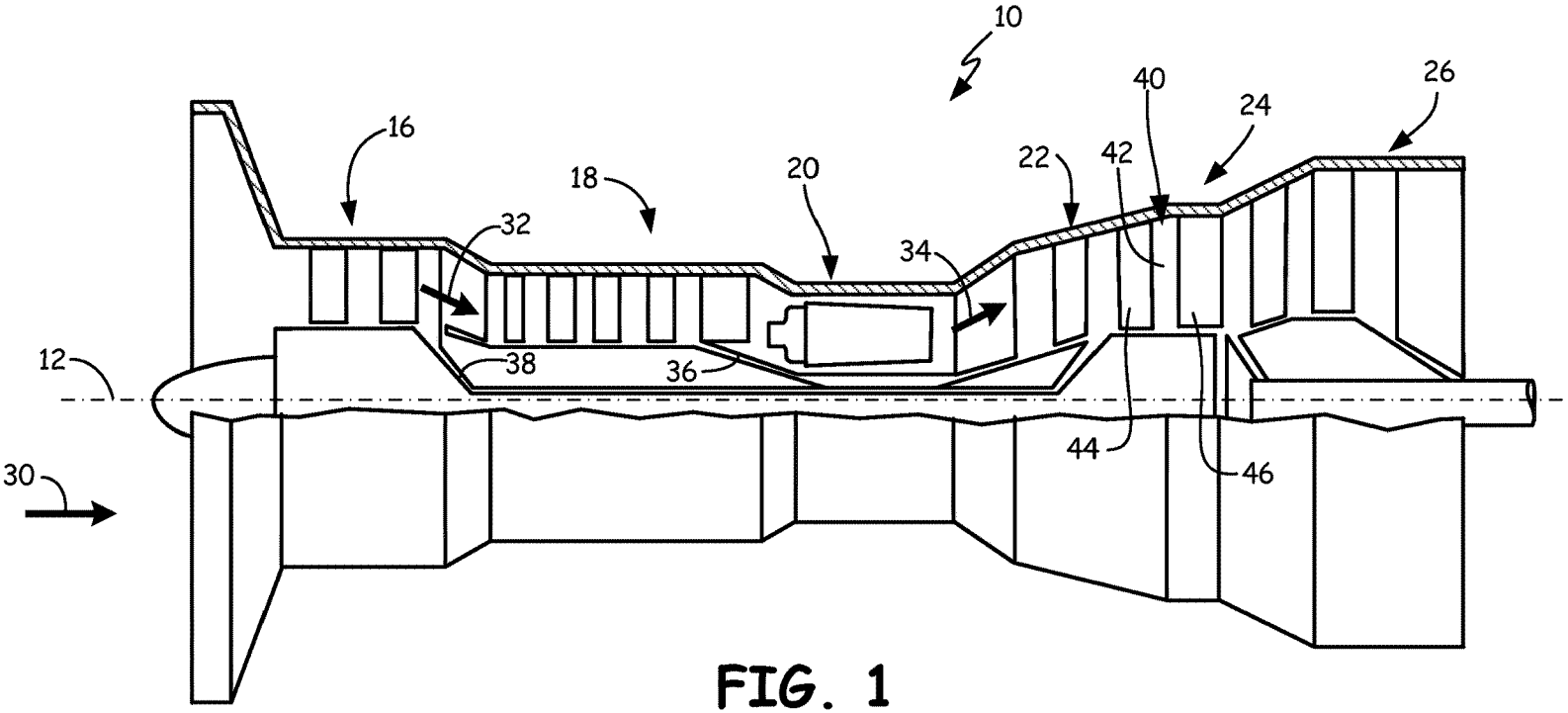
FIG. 1 is a side sectional schematic view of an industrial gas turbine engine.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine section 24.

As is well known in the art of gas turbines, incoming ambient air 30 becomes pressurized air 32 in the low and high pressure compressors 16 and 18. Fuel mixes with pressurized air 32 in combustor section 20, where it is burned. Once burned, combustion gases 34 expand through high and low pressure turbine sections 22, 24 and through power turbine section 26. High and low pressure turbine sections 22 and 24 drive high and low pressure rotor shafts 36 and 38 respectively, which rotate in response to the combustion products and thus rotate the attached high and low pressure compressor sections 18, 16. Power turbine section 26 may, for example, drive an electrical generator, pump, or gearbox (not shown).

Low pressure turbine section 24 includes turbine stage 40, which includes a plurality of turbine blades 42, which are circumferentially disposed about axial engine centerline axis 12. Turbine blades 42 are connected to and rotate with low pressure rotor shaft 38. Turbine blades 42 are spaced axially between stator vanes 44 and 46, which are stationary with respect to low pressure rotor shaft 38.

Figure 2:
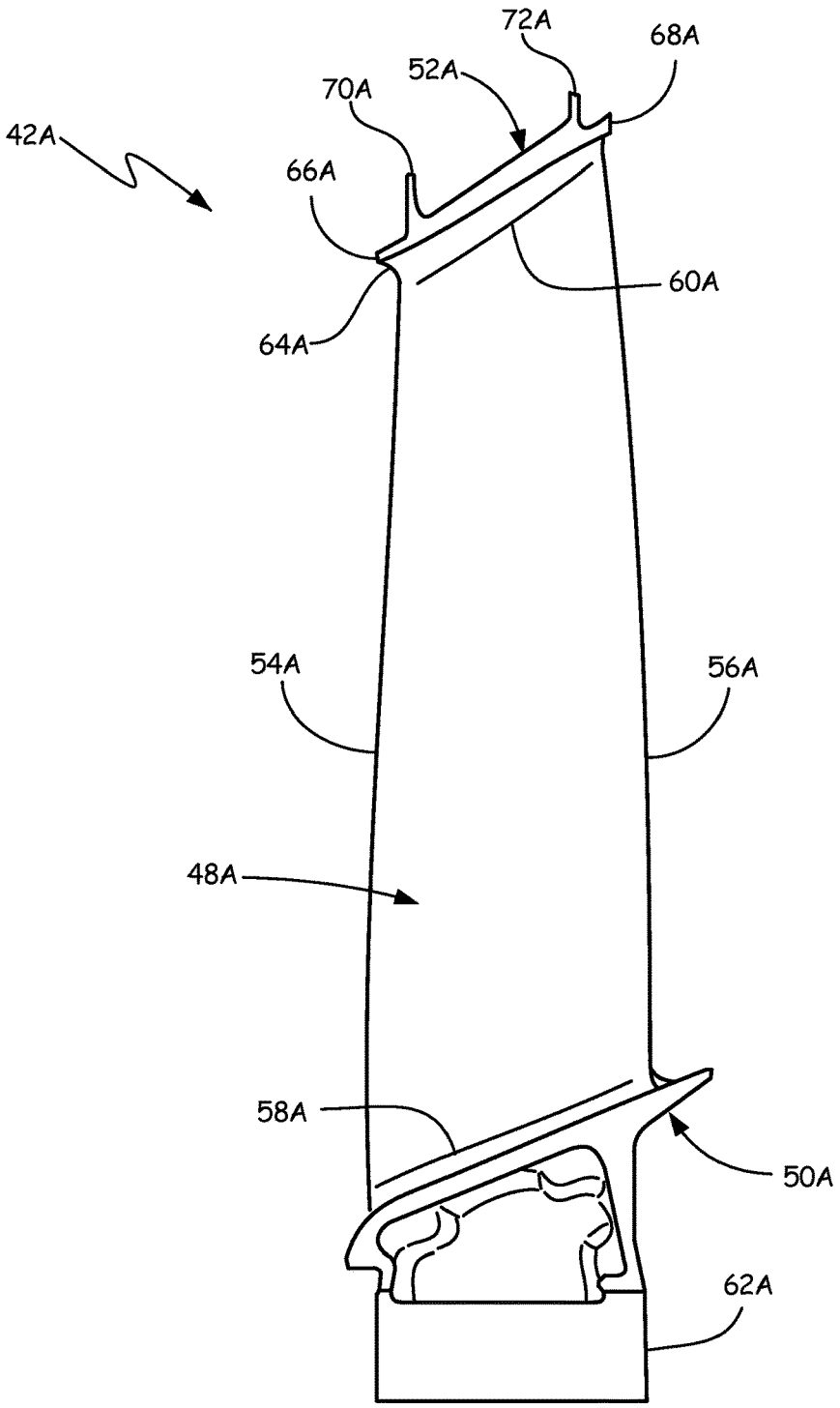
FIG. 2 is a side view of a turbine blade for use in the industrial gas turbine engine of FIG. 1.

FIG. 2 is a side view of turbine blade 42A, which is one of the circumferentially disposed turbine blades 42 (shown in FIG. 1) of gas turbine engine 10 (shown in FIG. 1). In the illustrated embodiment, turbine blade 42A is a component of low pressure turbine section 24 (shown in FIG. 1). In alternative embodiments, turbine blade 42A can be used in high pressure turbine section 22 (shown in FIG. 1) and/or power turbine section 26 (shown in FIG. 1).

Turbine blade 42A is a shrouded turbine blade that includes airfoil 48A extending from inner shroud 50A to outer shroud 52A. Airfoil 48A has leading edge 54A positioned axially forward of trailing edge 56A. Inner shroud 50A is connected to radially inner end 58A of airfoil 48A. Outer shroud 52A is connected to radially outer end 60A of airfoil 48A. Inner shroud 50A and outer shroud 52A define a radially inner and outer extent of a flow path through turbine stage 40 of low pressure compressor section 24. Rotor connection 62A is positioned radially inward of inner shroud 50A for connecting turbine blade 42A to low pressure rotor shaft 38.

Outer shroud 52A is connected to airfoil 48A at a curved fillet 64A. Outer shroud 52A includes leading edge overhang 66A extending axially forward of leading edge 54A and trailing edge overhang 68A extending axially aft of trailing edge 56A. Front knife edge seal 70A extends radially outward from outer shroud 52A near leading edge overhang 66A. Front knife edge seal 70A is substantially perpendicular to leading edge overhang 66A. Rear knife edge seal 72A extends radially outward from outer shroud 52A near trailing edge overhang 68A.

Figure 3:
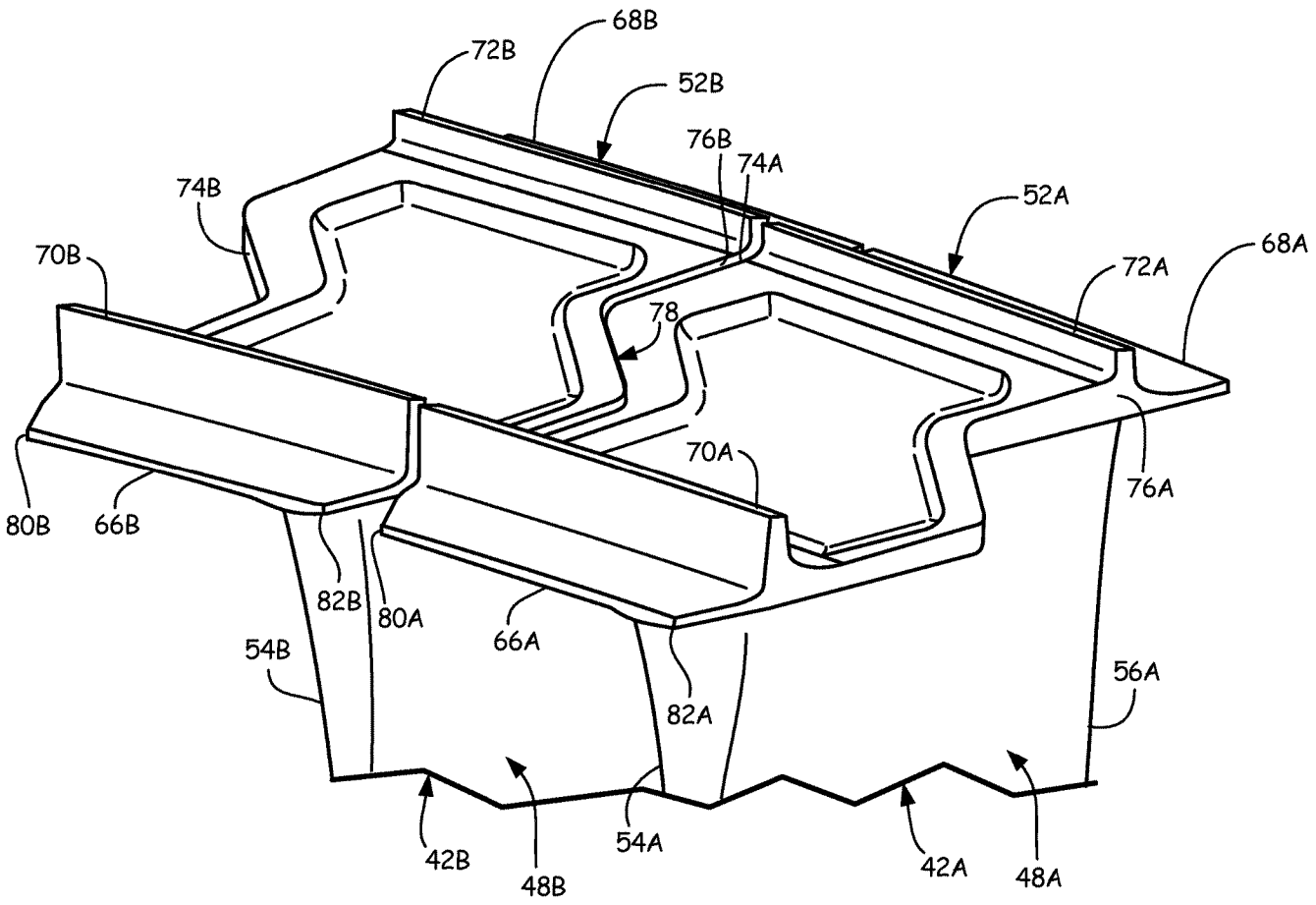
FIG. 3 is a perspective view of outer diameter shrouds on turbine blades as in FIG. 2, prior to cutting a corner of the shrouds.

FIG. 3 is a perspective view of outer shrouds 52A and 52B of turbine blades 42A and 42B. Turbine blade 42B is substantially the same as turbine blade 42A, except that turbine blade 42B is positioned adjacent turbine blade 42A. Turbine blades 42A and 42B are two of the turbine blades 42 in turbine stage 40 (shown in FIG. 1).

Outer shroud 52A includes opposite mate faces 74A and 76A. Mate face 74A is a hard (relatively thick) mate face and mate face 76A is a non-hard (relatively thin) mate face. Similarly, outer shroud 52B includes opposite mate faces 74B and 76B. Mate face 74B is a hard (relatively thick) mate face and mate face 76B is a non-hard (relatively thin) mate face. Mate faces 74A and 74B have a first z-lock shape. Mate faces 76A and 76B have a second z-lock shape that is complimentary to the first z-lock shape of mate faces 74A and 74B. Mate face 74A abuts mate face 76B to combine to form z-lock connection 78. Z-lock connection 78 holds turbine blades 42A and 42B together within turbine stage 40. Although only two turbine blades 42A and 42B are illustrated in FIG. 3, additional turbine blades (not shown) can be connected adjacent mate faces 76A and 74B in series, circumferentially around turbine stage 40.

In operation, various components of gas turbine engine 10 (shown in FIG. 1) can experience undesirable vibration. For example, turbine blades, such as turbine blades 42A and 42B, can experience vibration during engine operation that creates undesirable vibration characteristics on outer shroud 52A (and outer shroud 52B). Undesirable vibration characteristics forming on corner 80A and/or 82A of leading edge overhang 66A can shorten the useful life of turbine blades 42A and 42B and potentially cause failure of gas turbine engine 10.

Risk of damage to turbine blade 42A due to vibration can be reduced by first determining a vibration characteristic of turbine blade 42A. In one embodiment, the vibration characteristic can be determined analytically. Turbine blade 42A can be modeled via modeling software and vibration characteristics can be simulated. In an alternative embodiment, the vibration characteristic can be determined experimentally. Turbine blade 42A can be physically manufactured, and vibration characteristics can be tested.

Whether performed analytically or experimentally, one can determine whether turbine blade 42A has an undesirable vibration characteristic, such as a vibration mode shape with an anti-node at corner 80A and/or 80B. If turbine blade 42A has a vibration mode shape with an anti-node at corner 80A and/or 80B, leading edge overhang 66A can vibrate in a way so as to damage turbine blade 42A. Turbine blade 42A can then be modified by cutting off corner 80A and/or 80B where the anti-node is positioned. For example, if an undesirable anti-node is determined to be positioned at corner 80A, turbine blade 42A can be manufactured such that outer shroud 52A is shaped as shown in FIG. 3 and then machined to remove corner 80A such that outer shroud 52A is shaped as shown in FIG. 4.

Figure 4:
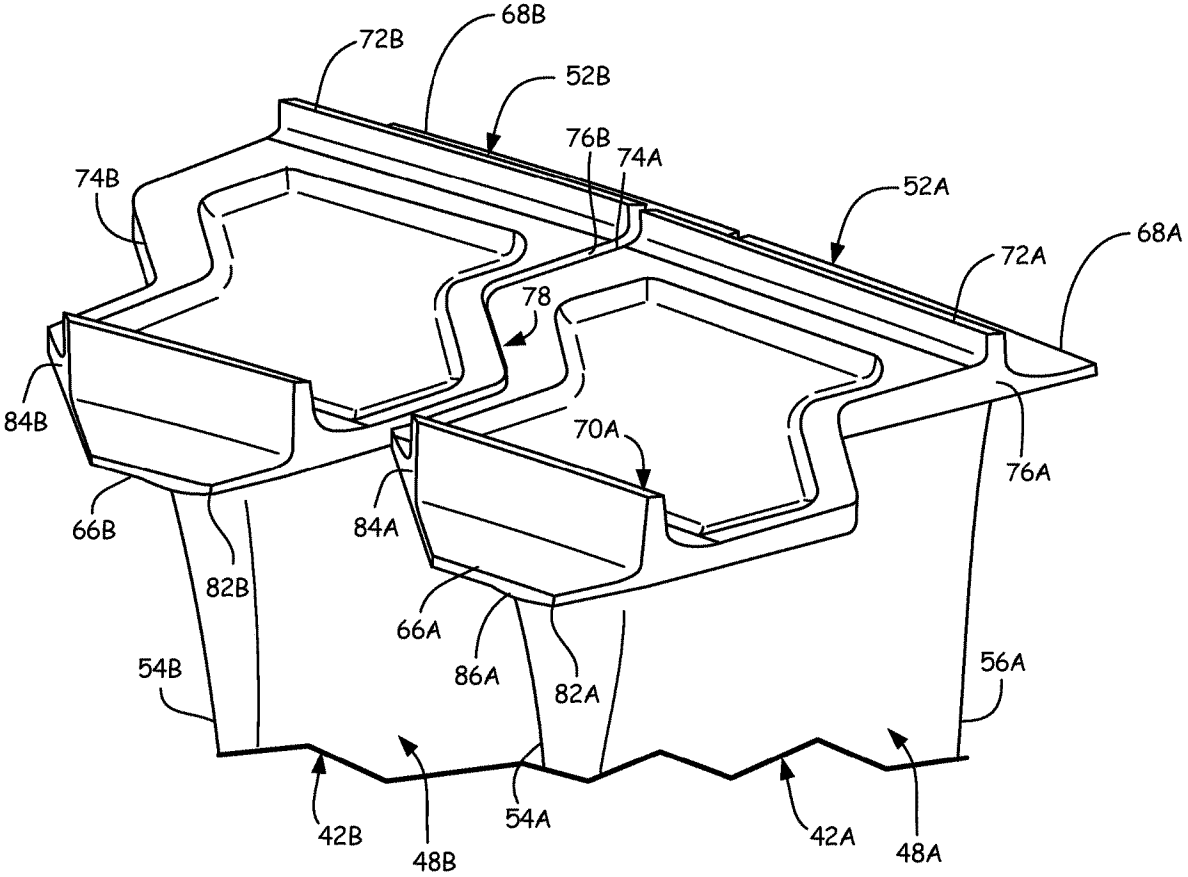
FIG. 4 is a perspective view of the outer diameter shrouds of FIG. 3, each with a corner cut off.

FIG. 4 is a perspective view of outer shrouds 52A and 52B of turbine blades 42A and 42B with corners 80A and 80B (shown in FIG. 3) cut off. Outer shroud 52A includes machined cut 84A extending from leading edge 86A of leading edge overhang 66A to mate face 74A. Machined cut 84A creates a diagonal edge that connects to the mate face 74A axially aft of leading edge 54A of airfoil 48A. Machined cut 84A shortens leading edge overhang 66A. Machined cut 84A substantially eliminates leading edge overhang 66A at mate face 74A but leaves leading edge overhang 66A at mate face 76A. Machined cut 84A can be substantially adjacent curved fillet 64A (shown in FIG. 2). Machined cut 84A is not complimentary to the z-lock shape of mate face 76B, but rather extends away from mate face 76B.

Machined cut 84A can shorten front knife edge seal 70A. In the illustrated embodiment, front knife edge seal 70A is positioned such that machined cut 84A cuts a portion of front knife edge seal 70A in addition to leading edge overhang 66A. In alternative embodiments, front knife edge seal 70A can be positioned such that machined cut 84A cuts leading edge overhang 66A, but not front knife edge seal 70A. Machined cut 84B can be substantially the same as machined cut 84A, such that outer shroud 52B has substantially the same shape as outer shroud 52A. In alternative embodiments, machined cuts 84A and 84B can be positioned and/or shaped differently than illustrated. For example, in one embodiment machined cuts 84A and 84B can cut off corners 82A and 82B as opposed to corners 80A and 80B.

Thus, machined cut 84A can alter the vibration mode shape of turbine blade 42A such that an undesirable anti-node does not form at corner 80A. This can reduce undesirable vibration characteristics of turbine blade 42A, and potentially extend the useful life of turbine blade 42A. Machined cut 84A can be made on turbine blade 42A that is already physically formed (as shown in FIG. 3), and thus allow for vibration characteristics to be corrected on an existing turbine blade 42A without having to redesign and reform a new turbine blade.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. For example, gas turbine engine 10 and its various components need not be configured precisely as illustrated, but can be configured as appropriate for a particular application.

DISCUSSION OF POSSIBLE EMBODIMENTS

The following are non-exclusive descriptions of possible embodiments of the present invention.

A method can include determining a vibration characteristic of a shrouded turbine blade that comprises an airfoil attached to a shroud and removing a corner of the shrouded turbine blade after determining the vibration characteristic.

The method of the preceding paragraph can optionally include, additionally and/or alternatively any, one or more of the following features, configurations and/or additional steps:

removing the corner of the shrouded turbine blade can include cutting a leading edge overhang of the shroud;

removing the corner of the shrouded turbine blade can include cutting a knife edge seal that extends radially outward from the shroud;

the vibration characteristic of the shrouded turbine blade can be determined experimentally;

the vibration characteristic of the shrouded turbine blade can be determined analytically;

determining the vibration characteristic of the shrouded turbine blade can include determining whether the shrouded turbine blade has a vibration mode shape with an anti-node at the corner;

the shroud can be an outer shroud attached to an outer end of the airfoil;

the corner can be cut substantially adjacent a curved fillet connecting the airfoil to the shroud; and/or removing the corner of the shrouded turbine blade can include machining the shrouded turbine blade after it has been physically formed.

A shrouded turbine blade can include a airfoil having an outer end and an outer shroud attached to the outer end. The outer shroud can include a first mate face having a first z-lock shape and a second mate face opposite the first mate face and having a second z-lock shape that is complementary to the first z-lock shape. A machined cut can be on a corner of the outer shroud extending from a leading edge of the outer shroud to the second mate face.

The shrouded turbine blade of the preceding paragraph can optionally include, additionally and/or alternatively any, one or more of the following features, configurations and/or additional components:

the first z-lock shape of the first mate face can be not complimentary to the machined cut;

the machined cut can shorten a leading edge overhang and a knife edge seal that extends radially outward from the outer shroud;

the machined cut can be substantially adjacent a curved fillet connecting the airfoil to the outer shroud; and/or the machined cut can be a substantially straight and diagonal cut.

A shrouded turbine blade can include a airfoil having an airfoil leading edge and an outer shroud attached to an outer end of the airfoil. The outer shroud can include a first mate face, a second mate face opposite the first mate face, an outer shroud leading edge positioned axially forward of the airfoil leading edge, and a diagonal edge of the outer shroud extending from the outer shroud leading edge to the second mate face. The diagonal edge can connect to the second mate face axially aft of the airfoil leading edge.

The shrouded turbine blade of the preceding paragraph can optionally include, additionally and/or alternatively any, one or more of the following features, configurations and/or additional components:

the first mate face can be not complimentary to the diagonal edge;

a knife edge seal can extend radially outward from the outer shroud between the first mate face and the diagonal edge;

the diagonal edge can be substantially adjacent a curved fillet connecting the airfoil to the outer shroud;

the diagonal edge can be a substantially straight and diagonal machined cut; and/or An industrial gas turbine engine can include a low pressure turbine section and a power turbine section positioned aft of the low pressure turbine section. The low pressure turbine section can include the shrouded turbine blade and a second shrouded turbine blade comprising a second outer shroud having a third mate face abutting the second mate face.

The invention claimed is:

1. A method comprising:

determining a vibration characteristic of a shrouded turbine blade that comprises an outer shroud attached to an outer end of an airfoil, wherein the outer shroud comprises:

a first mate face having a first z-lock shape;

a second mate face opposite the first mate face and having a second z-lock shape that is complementary to the first z-lock shape; and a leading edge; and machining a cut on a corner of the outer shroud extending from the leading edge to the second mate face after determining the vibration characteristic, wherein the cut shortens a leading edge overhang and a knife edge seal that extends radially outward from the outer shroud.

2. The method of claim 1, wherein the vibration characteristic of the shrouded turbine blade is determined experimentally.

3. The method of claim 1, wherein the vibration characteristic of the shrouded turbine blade is determined analytically.

4. The method of claim 1, wherein determining the vibration characteristic of the shrouded turbine blade comprises determining whether the shrouded turbine blade has a vibration mode shape with an anti-node at the corner.

5. The method of claim 1, wherein the corner is cut substantially adjacent a curved fillet connecting the airfoil to the shroud.

6. The method of claim 1, wherein machining the cut on the corner of the shrouded turbine blade comprises machining the shrouded turbine blade after it has been physically formed.

7. A shrouded turbine blade comprising:

an airfoil having an outer end; and an outer shroud attached to the outer end, wherein the outer shroud comprises:

a first mate face having a first z-lock shape;

a second mate face opposite the first mate face and having a second z-lock shape that is complementary to the first z-lock shape;

a leading edge; and a machined cut on a corner of the outer shroud extending from the leading edge to the second mate face, wherein the machined cut shortens a leading edge overhang and a knife edge seal that extends radially outward from the outer shroud.

8. The shrouded turbine blade of claim 7, wherein the first z-lock shape of the first mate face is not complimentary to the machined cut.

9. The shrouded turbine blade of claim 7, wherein the machined cut is substantially adjacent a curved fillet connecting the airfoil to the outer shroud.

10. The shrouded turbine blade of claim 7, wherein the machined cut is a substantially straight and diagonal cut.

11. A shrouded turbine blade comprising:

an airfoil having an airfoil leading edge;

an outer shroud attached to an outer end of the airfoil, wherein the outer shroud comprises:

a first mate face;

a second mate face opposite the first mate face;

an outer shroud leading edge positioned axially forward of the airfoil leading edge; and a diagonal edge of the outer shroud extending from the outer shroud leading edge to the second mate face, wherein the diagonal edge connects to the second mate face axially aft of the airfoil leading edge; and a knife edge seal that extends radially outward from the outer shroud between the first mate face and the diagonal edge.

12. The shrouded turbine blade of claim 11, wherein the first mate face is not complimentary to the diagonal edge.

13. The shrouded turbine blade of claim 11, wherein the diagonal edge is substantially adjacent a curved fillet connecting the airfoil to the outer shroud.

14. The shrouded turbine blade of claim 11, wherein the diagonal edge is a substantially straight and diagonal machined cut.

15. An industrial gas turbine engine comprising:

a low pressure turbine section comprising:

the shrouded turbine blade of claim 11, wherein the shrouded turbine blade is a first shrouded turbine blade and the outer shroud is a first outer shroud; and a second shrouded turbine blade comprising a second outer shroud having a third mate face abutting the second mate face; and a power turbine section positioned aft of the low pressure turbine section.

* * * * *